United States Patent [19]

Sherer et al.

[11] 4,357,813

[45] Nov. 9, 1982

[54] SELF-CLEANING UNDER BASKET LINT FILTER FOR AUTOMATIC WASHERS

[75] Inventors: Robert B. Sherer, St. Joseph Township, Berrien County; Edward E. Wiessner, Lincoln Township, Berrien County, both of Mich.

[73] Assignee: Whirlpool Corporation, Benton Harbor, Mich.

[21] Appl. No.: 211,761

[22] Filed: Dec. 1, 1980

[51] Int. Cl.[3] ..... D06F 13/02; D06F 39/10

[52] U.S. Cl. ..... 68/18 F; 210/167; 210/408; 210/411

[58] Field of Search ..... 68/18 F, 18 FA, 53; 210/167, 408, 409, 411, 495

[56] References Cited

U.S. PATENT DOCUMENTS

| | | | |
|---|---|---|---|
| 2,900,812 | 8/1959 | Smith | 68/23.7 X |
| 3,325,130 | 11/1967 | Landwier | 68/18 F |
| 4,075,876 | 2/1978 | Platt | 68/18 F |
| 4,137,735 | 2/1979 | Bright et al. | 68/18 D |

*Primary Examiner*—Philip R. Coe

*Attorney, Agent, or Firm*—Hill, Van Santen, Steadman, Chiara & Simpson

[57] ABSTRACT

A filter cone fixed to the bottom of a washing machine basket includes a plurality of closely spaced rigid teeth in a circumferential row extending outwardly and upwardly to divide the tub into first and second chambers for filtering laundry liquid during a washing cycle and for preventing sediment and debris from returning into the basket during a direct-into-spin portion of the wash cycle. The reverse flow of water through the filter teeth during the drain portion of the washing cycle effects self-cleaning of the teeth.

14 Claims, 6 Drawing Figures

SELF-CLEANING UNDER BASKET LINT FILTER FOR AUTOMATIC WASHERS

BACKGROUND OF THE INVENTION

1. Field of the Invention

This invention relates to automatic washing machines of the vertical axis type and more particularly to a filter system for such automatic washing machines.

2. Description of the Prior Art

U.S. Pat. No. 4,075,876 describes the problem occurring during the agitation and scrubbing of clothing articles in an automatic washing machine when particles of lint are developed from the fabrics being cleaned and become suspended in the laundry liquid. Such lint particles must be removed from the laundry liquid during the washing cycle, otherwise they will be redeposited on the articles being laundered in later steps of the washing program.

It is also known that sediment and debris particles are also removed from clothing articles during the agitation and scrubbing of the clothing articles. Such sediment and debris particles tend to gravitate to the bottom of the washing basket or washing tub.

In one form of automatic washer manufactured and sold by applicants' assignee, the motor in the washing machine is reversed after the agitation cycle and the drain pump is actuated to drain the basket and tub of laundry liquid. At the same time the basket is driven in rotation for the spin cycle or centrifuging mode. Such a cycle sequence is sometimes referred to as a direct-into-spin system because the basket begins its spin cycle before the washing liquid has been drained therefrom.

Such a direct-into-spin system can cause a pressure gradient forcing the laundry liquid from the tub through openings in the bottom of the basket and outwardly through the clothes, thus distributing sediment and debris particles that have settled within the tub on the clean clothes.

U.S. Pat. No. 3,352,130 discloses a filtering arrangement in an automatic washer wherein liquid is pumped from a tub to a closed receptacle or basket by the pumping action of an agitator oscillating within the basket during the washing cycle. Liquid enters the basket from the tub through openings in the bottom of the basket, and liquid circulates from the basket to the tub through perforations in the basket side wall.

Filter elements mounted in the openings in the bottom of the basket collect the lint carried by liquid passing through the openings, and the lint thus collected is thrown off and carried to drain when the basket spins during the centrifuging mode of machine operation. A row of holes is provided in the bottom wall of the basket for permitting sand and other sediment to pass from the basket to the tub. This row of holes formed in the bottom wall of the basket permits unfiltered communication between the basket and the tub. Operating such a structure with a direct-into-spin cycle would allow the deposited sand and sediment particles to reenter the basket area through these holes to be redeposited on the laundered articles.

SUMMARY OF THE INVENTION

A truncated filter cone constructed of a rigid material such as polypropylene is fastened beneath the bottom of a clothes basket, by means of a plurality of fingers at the top of the cone having buttons on the ends thereof being received in holes formed in the hollow center post portion of the basket. The filter cone comprises a generally truncated conical shape which is positioned adjacent the bottom wall of the basket near the upper end of the cone and is spaced from the bottom wall of the basket at the lower end of the cone. The lower end or periphery of the cone has upwardly and outwardly extending rigid teeth spaced closely subjacent the bottom wall of the basket along a generally circular line.

As a pumping agitator mounted in the basket draws liquid along a path radially inward from the periphery of the tub sump beneath the basket, lint carried by the liquid is trapped on and between the teeth of the filter cone. The liquid is drawn through apertures in the bottom wall of the basket and into the basket through the agitator. The liquid then flows outwardly through a side wall in the basket and downwardly toward the sump to repeat the cycle.

During the direct-into-spin portion of the cycle, a pressure differential is established by the spinning of the basket, tending to cause laundry liquid to flow back into the basket through the openings in the bottom wall. During this portion of the cycle, the rotating rigid filter teeth provide a pumping action to oppose this flow and along with the conical shape of the filter prevent sand or sediment from returning to the basket to be deposited on the clothing.

As the water level within the tub is decreased by the drain pump the pumping action of the filter teeth causes water flow outwardly from the basket through the openings in the bottom of the basket, thereby automatically cleaning the filter teeth. The lint then moves to drain from the tub along with the laundry liquid, thus automatically effecting a cleaning of the filter without manual intervention.

DESCRIPTION OF THE PREFERRED EMBODIMENTS

Figure 1:
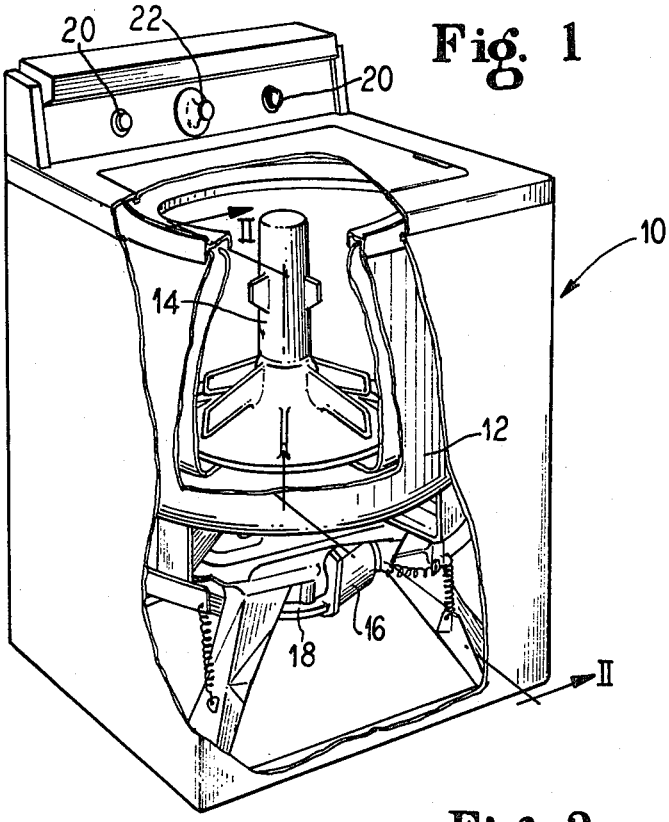
FIG. 1 is a perspective view of an automatic washing machine with parts broken away to show the mechanical parts of a washing machine including a tub with a vertical agitator and embodying the principles of the present invention.

In FIG. 1 a washing machine is generally shown at 10 as having a tub 12 and a vertical agitator 14 therein, a water supply (not shown), a power supply (not shown), an electrically driven motor 16 operably connected via a transmission 18 to the agitator 14, and controls 20 including a pre-settable sequential control means 22 for use in selectively operating the washing machine 10 through a selected programmed sequence of washing, rinsing and spinning or extracting steps.

Figures 2, 4:
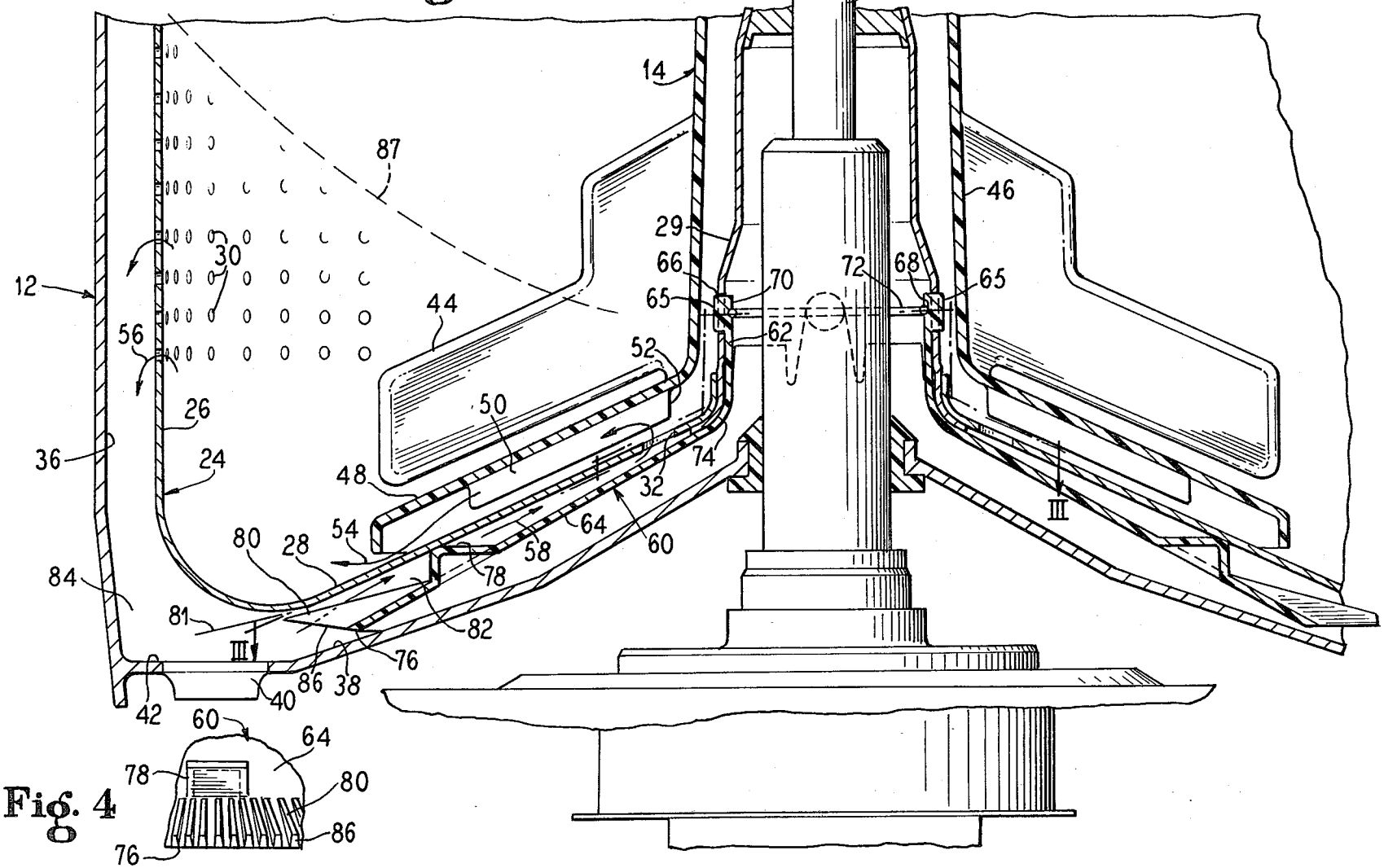
FIG. 2 is a fragmentary cross sectional view with parts shown in elevation taken generally along line II—II of FIG. 1.
FIG. 4 is a partial side elevational view of the filter cone taken generally along the lines IV—IV of FIG. 3.

FIG. 2 shows a cross sectional view of the interior of the tub 12 which shows a concentrically mounted perforate basket 24 having a side wall 26 and a bottom wall 28. The bottom wall slopes upwardly from the outer circumference at the side wall 26 to a center post portion 29. A plurality of openings 30 are formed in the side wall 26 and a series of openings 32 are formed in the bottom wall 28 adjacent the center post portion 29 thereof.

The tub 12 is comprised of an imperforate side wall 36 and a generally imperforate bottom wall 38 having a single drain opening 40 formed in a sump portion 42 of the bottom wall 38. The agitator 14 has a plurality of vanes 44 extending radially from a central vertical portion 46 thereof. The vanes 44 may have flexibility if so desired. The agitator vertical portion 46 is concentrically mounted about the basket center post 29 and is driven by an agitator drive shaft 47 by means of a conventional spline connection (not shown).

A skirt portion 48 of the agitator 14 is provided below the flexible vanes 44 and includes a pumping means 50 comprising radial vanes located beneath the skirt portion 48 by which the agitator pumping means 50 pumps laundry liquid outwardly upon each oscillation of the agitator 14. The openings 32 in the bottom wall 28 of the basket are located below and near a radially inward end 52 of the pumping means 50 of the agitator such that laundry liquid is drawn up through openings 32 and is caused to flow radially outwardly through pumping means 50 by the centrifugal force imparted by the oscillating agitator 14.

Liquid flows out from under the skirt 48 as at arrow 54 to enter the basket 24 and then flows outwardly through the holes 30 in the basket side wall 26 as at arrows 56 and downwardly past the sump portion 42 of the tub radially inwardly along the underside of the basket bottom wall 28 as at arrows 58 to return to the interior of the basket 24 through openings 32. As the laundry liquid passes in this liquid circuit, sand and other heavy dirt particles or debris are generally deposited along the sump portion 42 of the tub 12.

Figure 5:
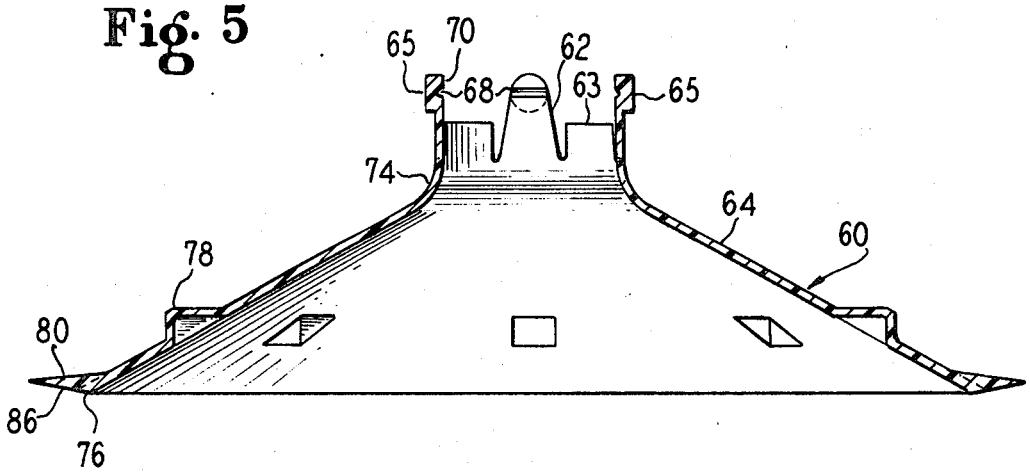
FIG. 5 is a cross sectional view of the filter cone taken in the plane of line V—V of FIG. 3.

A conical filter means or element 60 is provided between the sloping bottom wall 28 of the basket 24 and the bottom wall 38 of the tub 12. The cross sectional shape of the filter element is best seen in FIG. 5. The filter element 60 is attached to the basket 24 by means of a plurality of fingers 62 which extend radially upwardly at a top end 63 of a conical wall 64 which forms the main body of the filter element 60. The fingers 62 have radially protruding buttons 65 formed at a top end thereof which are received through complementary shaped openings 66 in the basket center post 29 as best seen in FIG. 2.

A groove 68 is formed on the interior side wall 70 of the buttons 65 to receive a retaining ring 72 which urges the fingers 62 and buttons 64 in a radially outward direction to retain buttons 65 in the openings 66 of the center post 29. The finger portions 62 of the cone filter element 60 merge with the conical wall 64 in a generally curved manner as at 74 where the conical wall 64 is in close proximity to the bottom wall 28 of the basket 24.

As the conical wall 64 progresses radially outwardly from merger point 74, it is sloped downwardly at a greater angle than the slope of the bottom wall 28 of the basket 24 such that a lower end 76 of the conical wall 64 is spaced from the bottom wall 28 of the basket 24. To maintain this spaced relationship, a plurality of steps 78 are provided in the conical wall 64 to abut against the bottom wall 28 of the basket 24.

A plurality of teeth 80 are provided at the lower end 76 of the conical wall 64 which extend radially outwardly to a position closely subjacent the bottom wall 28 of the basket 24 leaving an opening 81 there between. In accordance with this invention, the teeth 80 are made rigid. Thus, the teeth 80 form a stable barrier between a first tub region or chamber 82 located radially inward of the teeth 80 and above the conical wall 64 and a second tub region or chamber 84 radially outward of the teeth 80. The first tub region or chamber 82 comprises an annular passageway between the second tub region or chamber 84 and the openings 32 leading into the basket 24 which is bounded on an upper side by the basket bottom wall 28 and on the lower side by the conical wall 64.

When the agitator 14 oscillates, the pumping means 50 pumps liquid radially outwardly on the interior of the basket 24 along the bottom wall 28 of the basket. The liquid then flows upwardly through the basket and out through the openings 30 in the side wall 26 of the basket 24 into the second tub chamber or portion 84. The liquid passes the sump portion 42 and then flows between and over the filter teeth 80 into the first tub portion or chamber 82 and back through the openings 32 in the bottom wall 28 of the basket 24 to repeat the cycle. Any lint suspended in the liquid is retained against an outside surface 86 of the teeth preventing the lint from being redeposited on the laundered articles.

When the washing cycle progresses into a direct-into-spin portion of the cycle spinning the basket 24 and thus the filter element 60, a pressure gradient, as shown by line 87 in FIG. 2, results in the liquid wherein the pressure along the tub bottom wall 38 is greatest at the side wall 36 and lowest adjacent the agitator center post 14. This pressure difference or gradient would normally cause a flow of water radially inwardly along the tub bottom wall 38 tending to result in a return flow into the basket 24 through openings 32. The rotating rigid filter teeth 80, however, provide a pumping action opposing flow from the tub through the teeth and inwardly through openings 32 into the basket. There is thus no flow into the basket through openings 32. As the water level in the basket decreases, the pumping action of the teeth 80 causes an increased flow outwardly from the basket, through openings 32 and teeth 80 into the tub 12. Thus, the rotating rigid filter teeth 80 and the conical wall 64 provide a barrier which prevents the sediment and debris which has accumulated in the sump portion 42 from returning to the basket 24.

When the water level in the tub 12 is sufficiently decreased by passage of liquid through the drain 40, the pumping action of the filter increases due to the reduced pressure at side wall 36. The flow of water increases through the holes 32 in the bottom wall 28 of the basket 24, flowing radially outwardly between the teeth 80, to thereby aid the centrifugal force created by the rotation of the filter element 60 in cleaning the lint and debris from the outer surface 86 of the teeth 80. The annular opening 81 allows any lint or debris in region 82 to pass outwardly into region 84. Such lint and debris in region 84 is carried by the draining liquid through the drain 40 with the waste water.

Figure 3:
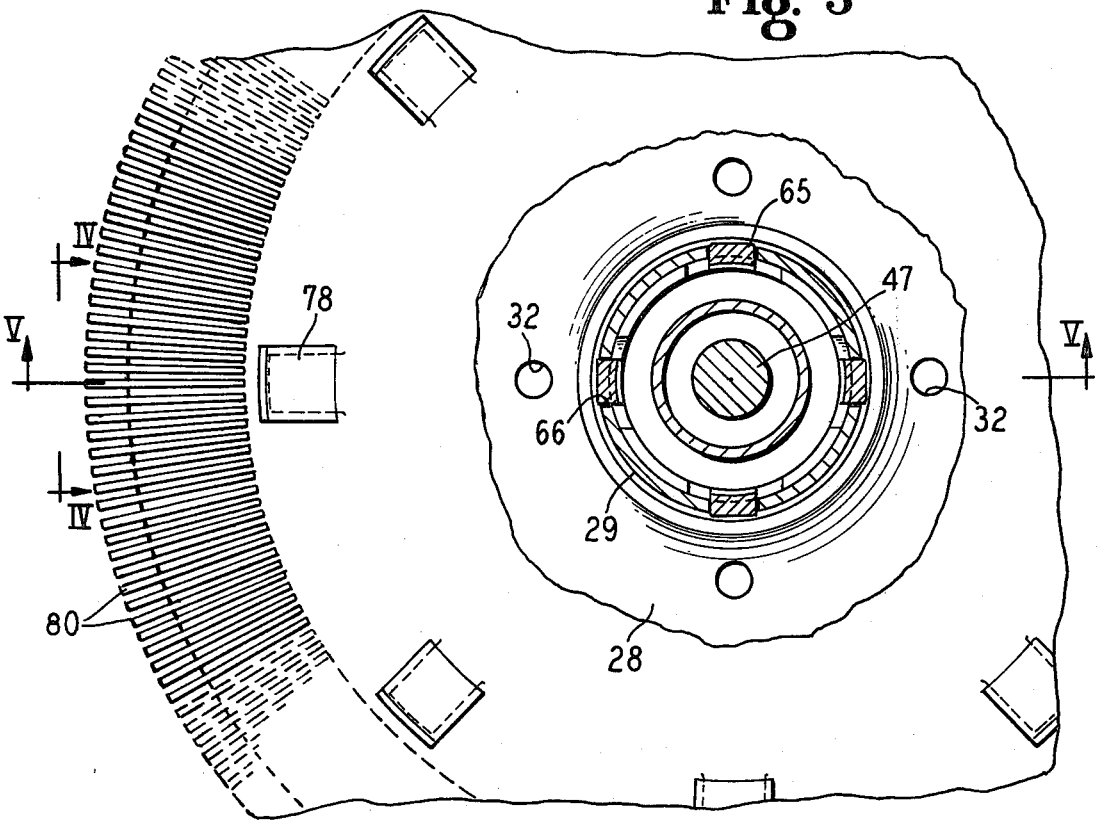
FIG. 3 is a cross sectional view taken generally along the line III—III of FIG. 2 showing the plan view of a filter cone.

As seen in FIG. 3, the teeth 80 may be formed in a direction extending radially outwardly from the agitator drive shaft 47. The steps 78 are provided at sufficiently spaced apart locations to allow for unimpeded flow along the conical wall 64 as the wash liquid travels between the teeth 80 and the openings 32 in the basket bottom wall 28.

A side elevational view of a portion of the filter cone 60 is shown in FIG. 4 showing the relationship between the filter teeth 80 and front surfaces 86 thereof, the lower end 76 of the cone wall 64 and the steps 78.

Figure 6:
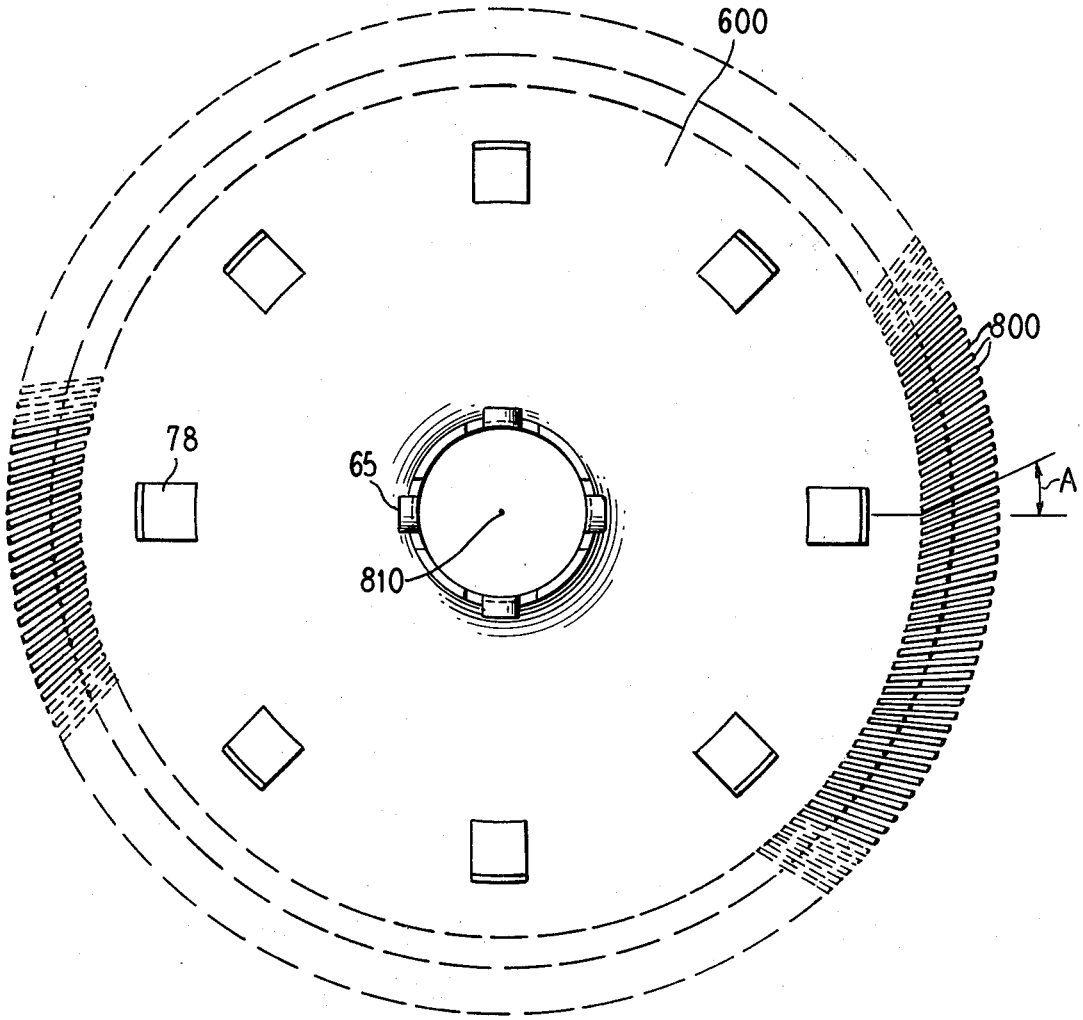
FIG. 6 is a plan view of a filter cone embodying optional features of construction.

An alternative embodiment of the invention is shown in FIG. 6 wherein an alternative cone filter element 600 is shown having teeth 800 formed at an angle A with respect to radial lines projecting from a conical center 810.

Although a filter cone having fingers of a configuration like those shown in FIGS. 3 and 6 is preferred, it will be understood that many different forms of filtering barriers and many different configurations of lint collecting teeth could be effectively utilized within the scope of our invention. While these and other various modifications might be suggested by those versed in the art, it should be understood that we wish to embody within the scope of the patent warranted hereon all such modifications as reasonably and properly come within the scope of our contribution to the art.

The embodiments of the invention in which an exclusive property or privilege is claimed are defined as follows:

1. In a washing machine of the vertical axis type having a tub having a lower wall for containing laundry liquid, a basket mounted in the tub on said vertical axis for containing articles to be washed and having a lower wall spaced adjacent said wall of the tub, and pump means for circulating laundry liquid to said basket from said tub; filter means for filtering the circulating laundry liquid, said filter means comprising:

a filter cone located entirely outside said basket and extending between said lower wall of said tub and said lower wall of said basket independent of said tub and being substantially circumferentially continuous about said axis to define annularly continuous first and second tub regions outside said basket wall, said first tub region including an annular passageway from said second tub region to said basket bounded on an upper side by said basket lower wall and on a lower side exclusively by said filter cone, said filter cone including a plurality of rigid teeth forming a stable filter barrier extending from an outer periphery of said filter cone to said lower wall of said basket for filtering suspended foreign particles from all liquid passing from said second to said first tub region, said circulating liquid flowing generally along a path in said first tub region along said lower wall of said basket, into the interior of said basket, from the basket into said section tub region, and past said filter ring back to said first tub region.

2. In a washing machine of the vertical axis type having a tub having a lower wall for containing laundry liquid, a basket mounted in the tub on said vertical axis for containing articles to be washed and having a lower wall spaced adjacent said wall of the tub, and pump means for circulating laundry liquid to said basket from said tub; filter means for filtering the circulating laundry liquid, said filter means comprising:

a filter cone located entirely outside said basket and extending between said lower wall of said tub and said lower wall of said basket and being substantially circumferentially continuous about said axis to define annularly continuous first and second tub regions outside said basket wall, said first tub region including an annular passageway from said second tub region to said basket bounded on an upper side by said basket lower wall and on a lower side by said filter cone, said filter cone including a plurality of rigid teeth forming a stable filter barrier extending from an outer periphery of said filter cone to said lower wall of said basket for filtering suspended foreign particles from all liquid passing from said second to said first tub region, said circulating liquid flowing generally along a path in said first tub region along said lower wall of said basket, into the interior of said basket, from the basket into said section tub region, and past said filter ring back to said first tub region, said basket comprising a substantially hollow cylindrical center post extending upwardly from said basket lower wall and said filter means is attached to the hollow interior of said center post by appropriate fastening means.

3. In a washing machine as claimed in claim 2, wherein said fastening means comprises a plurality of openings formed in said center post, said filter cone having a plurality of fingers having buttons on the ends thereof to be received in said holes to retain said filter cone against said basket.

4. In a washing machine as claimed in claim 1, the filter cone having elongated, thin teeth, said teeth being rigid and extending upwardly and outwardly to closely subjacent said lower wall of said basket.

5. In a washing machine as claimed in claim 4, wherein said teeth project radially outward toward said second tub region.

6. In a washing machine as claimed in claim 4, wherein said teeth project angularly outward toward said second tub region.

7. In a washing machine having a tub having a lower wall portion for containing laundry liquid, a basket mounted in the tub for containing articles to be washed and having a lower wall portion adjacent said wall portion of the tub, and pump means for circulating laundry liquid to said basket from said tub, filter means for filtering the circulating laundry liquid, said filter means comprising:

a filter cone extending between said lower wall portion of said tub and said lower wall portion of said basket independent of said tub to define first and second tub regions outside said basket, said first tub region being an annular passageway from said second tub region to said basket and being bounded on an upper side by said basket bottom wall portion and on a lower side exclusively by said filter cone, said filter cone including a plurality of rigid teeth extending from an outer periphery of said filter cone to said bottom wall portion of said basket for filtering suspended foreign particles from liquid passing from said second to said first tub region, said circulating liquid flowing generally along a path from said first tub region, to the interior of said basket, to said second tub region, and past said filter cone teeth back to said first tub region, and wherein said basket forms a first set of openings through said lower wall portion thereof for affording liquid communication between said first tub region and said basket interior, and wherein said basket further forms a second set of openings through said lower wall portion thereof radially outwardly of said first set of openings for affording liquid communication between said second tub region and said basket interior.

8. In a washing machine as claimed in claim 7 wherein said basket includes a perforate sidewall affording liquid communication therethrough from said basket into said second tub region.

9. In an automatic washer having a tub for containing wash liquid, and an axially-symmetric basket mounted within said tub for containing wash liquid and items to be washed, said basket having a wall forming a first and a second set of openings through said wall, said openings spaced radially apart from one another in said wall; a filter system for filtering foreign matter from said wash liquid during a washing operation, said filter system comprising:

pump means for providing a circulation of said wash liquid between said tub and the basket interior during said washing operation, said circulation of said wash liquid causing said wash liquid to pass from said tub to said basket through said first set of openings and from said basket to said tub through said second set of openings; and filter means mounted on a conical wall between said tub and said basket independent of said tub and spaced radially between said first and second sets of openings for dividing said tub outside said basket into a first and a second chamber, said first chamber of said tub comprising an annular passageway from said second chamber to said basket bounded on an upper side by said basket wall adjacent said first set of openings and on a lower side exclusively by said conical wall, said first chamber in liquid communication with said basket through said first set of openings and said second chamber of said tub in liquid communication with said basket through said second set of openings, said filter means permitting flow of said wash liquid and substantially blocking flow of said foreign matter from said second to said first chamber of said tub.

10. In an automatic washer as defined in claim 9 and further defined by said basket wall having an underside and by said basket rotating at high speed during a liquid removal operation following said washing operation, the filter system further defined by said filter means being a filter cone affixed to said underside of said basket, whereby foreign matter collected by said filtering during said washing operation is rinsed from said filter cone during said liquid removal operation.

11. An automatic washer comprising:

a tub for containing wash liquid;

a basket rotatably mounted within said tub for containing wash liquid and items to be washed, said basket having a hollow center post portion, a lower wall portion and an outer wall portion including a first set of openings through said lower wall portion and a second set of openings through said outer wall portion radially outwardly of said first set of openings;

pump means for circulating said wash liquid between said first and second sets of openings, said wash liquid passing from said tub to said basket through said first set of openings and from said basket to said tub through said second set of openings; and a filter cone mounted beneath said basket comprising a truncated conical wall attached to said basket adjacent said center post, said conical wall having a plurality of rigid teeth at an outer periphery of said conical wall extending between said conical wall and said basket to form an annular barrier cooperating with said lower wall portion of said basket to divide said tub into a first chamber and a second chamber, said first chamber in liquid communication with said basket through said first set of openings and said second chamber in liquid communication with said basket through said second set of openings, said annular barrier of rigid teeth permitting the passage of liquid but collecting foreign matter thereon, and said collected foreign matter being released to a drain in a liquid removal cycle which reverses the flow of liquid through said barrier.

12. In an automatic washing machine of the vertical axis type having a generally axially-symmetric imperforate tub with a side wall and a bottom wall for containing wash liquid; a basket having a bottom wall and a side wall rotatably mounted about said axis within said tub and having at least two areas of liquid communication with said tub; and debris collection means; said collection means comprising:

an annular conical filter element positioned between said two areas of communication between said tub and said basket and cooperating exclusively with said basket bottom wall to form a path of communication between said two areas, whereby collected particles are prevented from being redeposited on laundered clothes.

13. The washing machine of claim 12 wherein a first of said areas of communication is in said bottom wall of said basket and a second of said areas of communication is in said side wall of said basket, radially outward of said first area of communication.

14. The washing machine of claim 13 wherein said annular conical filter element comprises a truncated conical wall having an upper end adjacent to and attached to said basket bottom wall and a lower end spaced from said basket bottom wall but having rigid filter teeth extending between said lower end and said bottom wall intermediate said first and second areas of communication.

* * * * *